United States Patent [19]

Pinto et al.

[11] Patent Number: 4,890,357

[45] Date of Patent: Jan. 2, 1990

[54] APPARATUS FOR CLEANING TEXTILE FIBER MATERIAL

[75] Inventors: Akiva Pinto, Duesseldorf; Guenter Lucassen, Haltern; Bernhard Bocht, Neubulach, all of Fed. Rep. of Germany

[73] Assignee: Hergeth Hollingsworth GmbH, Duelman, Fed. Rep. of Germany

[21] Appl. No.: 255,811

[22] Filed: Oct. 11, 1988

[30] Foreign Application Priority Data

Oct. 12, 1987 [DE] Fed. Rep. of Germany ..... 3734485

[51] Int. Cl.[4] ..... D01B 3/00

[52] U.S. Cl. ..... 19/64.5

[58] Field of Search ..... 19/55 R, 64.5, 114, 19/202, 204

[56] References Cited

U.S. PATENT DOCUMENTS

| | | | |
|---|---|---|---|
| 732,869 | 7/1903 | Larson | 19/55 R |
| 854,905 | 5/1907 | Park | 19/55 R |
| 4,262,390 | 4/1981 | Einglett et al. | 19/64.5 |
| 4,606,095 | 8/1986 | Egerer | 19/97 |

FOREIGN PATENT DOCUMENTS

| | | | |
|---|---|---|---|
| 1216262 | 3/1986 | U.S.S.R. | 19/55 R |

*Primary Examiner*—Werner H. Schroeder
*Assistant Examiner*—Douglas Price
*Attorney, Agent, or Firm*—Cort Flint

[57] ABSTRACT

Apparatus for cleaning textile fibers such as cotton, etc. is disclosed wherein the fibers are conveyed by an air current to an opening roller cooperating with a grate, and the transport air is separated at a feed box. The separated air (17) serves for discharging contaminants accumulating in a space (9, 11) beneath the cleaning grate (8). The opening roller (7) may be provided with a toothed wire (20) whose teeth have a relatively acute top rake (22).

11 Claims, 2 Drawing Sheets

APPARATUS FOR CLEANING TEXTILE FIBER MATERIAL

BACKGROUND OF THE INVENTION

The invention relates to an apparatus for cleaning textile material of natural or synthetic fibers, e.g. cotton. The fiber material is conveyed by an air current through a feed box to an opening roller cooperating with a cleaning grate. The conveying air is separated at the feed box. The waste resulting from contaminations accumulates beneath the cleaning grate and is discharged.

It has been known, in case of general textile fiber material opening means (GB No. 21 08 543), to separate the conveying air in advance of a processing machine and remove it as spent air from the process. Alternately, it is known to use it for the transport of the opened fiber material to another stage of the process. In the first mentioned case, high expenses are incurred for cleaning the transport air before it is dismissed into the atmosphere. In the last mentioned case, the separated transport air is recycled into the process. In general, the separated transport air is polluted with dust and other contaminants. Since the fiber material has already passed one or more processing states, it is again exposed to dust or other contaminating particles and the further fiber opening procedure is affected accordingly.

It is an object of the present invention to provide an air duct in connection with a cleaning apparatus due to which a high cleaning effect is obtained with a low loss of material fibers and the air duct may be operated economically as well by saving energy.

SUMMARY OF THE INVENTION

The above objections are accomplished according to the invention in that, in case of an apparatus of the type specified, the separated transport air of the fiber-laden air flow serves for discharging the contaminants which are accumulated beneath the cleaning grate. Advantageously, the already contaminated transport air is used to carry away waste. The cleaned opened fiber material is not adversely affected this way. The impurities entrained by the conveying air current, and additional contaminants worked out by an opening roller of the cleaning means and regarded as waste, are subjected to cleaning and dismissed subsequently into the atmosphere. The fiber material is not further contaminated for processing during future operations. Energy is saved because excess pressure still present in the separated conveying air current is advantageously utilized for the waste discharge. According to another feature of the invention, the opening roller which cooperates with a cleaning grate is provided with a toothed wire. The top rake of the teeth of the wire is relatively acute and ranges preferably between 30 degrees and 40 degrees, particularly between 34 degrees and 37 degrees. Due to the toothed wire design used for the cleaning roller, the material fibers remain on the opening roller in spite of the constantly acting underpressure, and the cleaning effect is excellent. Further, an undesired amount of material fibers is prevented from getting into the waste due to the constantly acting underpressure which is effective for removing the impurities. At the same time, a continuous operation is possible. The cleaning means need not be stopped for removing the accumulated waste from the machine.

The measure taken according to the invention is applicable to cleaning apparatus in which the collecting chamber for the contaminants is closed by an openable wall portion against the conveying air current, and also to a configuration in which the space beneath the cleaning grate of a separating means is free from conveying air current. The advantages and effectiveness of the cleaning apparatus according to the invention may also be provided if an additional separate discharge air current for the waste is operative beneath the cleaning grate.

DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
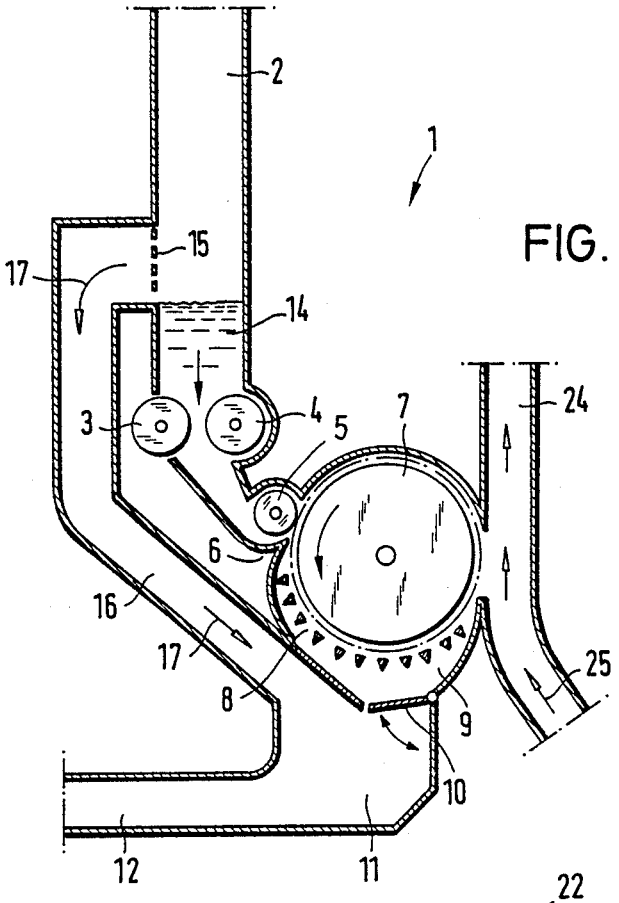
FIG. 1 is an elevational and schematic view of an embodiment of the cleaning apparatus of the invention.
Figure 2:
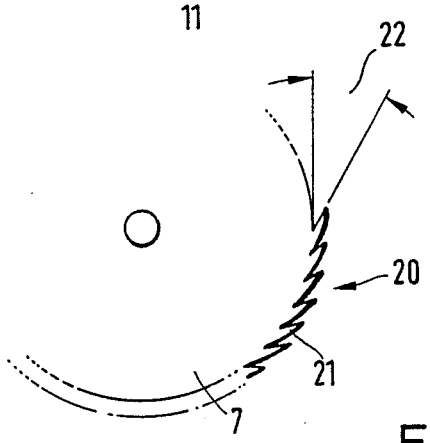
FIG. 2 is a schematic view of the configuration of the wire of the cleaning roller.

Referring now in more detail to the drawings, a cleaning apparatus, designated generally as A, is illustrated having a feed box 2 which extends by means of feed rollers 3 and 4, and another roller 5 with intake trough 6, to an opening roller 7. Opening roller 7 cooperates with a grate 8, beneath which a collecting chamber 9 is disposed for the waste resulting from the contaminants. Collecting chamber 9 may be closed by a wall portion (flap) 10 or the like thus forming a subjacent space 11, from which waste is drawn off by a suction-in duct 12.

The fiber flocks are introduced by a conveying air current 17 in a known manner into the feed box 2. The fiber material 14 is separated from the transport air which flows through a screen surface 15 and duct 16 into the waste chamber 11. The separated air current 17 serves for discharging the particles removed during cleaning out of space 11. The contaminants are then conveyed through duct 12. The collecting chamber 9 for the impurities discharged from the grate 8 is selectively closed against space 11 by flap 10 or the like. The evacuation of collecting chamber 9 is achieved while the cleaning apparatus is stopped. This avoids a higher amount of fiber materials from being entrained by air current 17 and drawn into discharge channel 12. Suitably, cleaning of this embodiment is performed intermittently. A continuous waste transport may be carried out by interposing a barrier between spaces 8 and 11. For instance, a flap 10, a cell wheel sluice, or the like to prevent an undesired amount of material fibers from the fiber flow entering the suction flow of the waste.

It has been found that a continuous waste transport by means of suction air without interposing a barrier is possible if the wire 20 of opening and cleaning roller 7 comprises teeth 21 having a relatively acute top rake 22. The acute top rake is preferably within a range of 30 degrees to 40 degrees, preferably of 34 degrees to 37 degrees. An angle of 36 degrees is particularly adequate and preferred. In spite of the constantly acting suction resulting from the exhaust air current, the material fibers remain on opening roller 7. Thus, the separating means normally used, such as flaps, cell wheel sluice, slide and the like may be omitted with a resultant saving of costs. The cleaned fibers are discharged through duct 24 by a conveying air current 25 in a tangential direction to cleaning roller 7. By means of this arrangement, the cleaned fibers may be well removed from the wire of opening roller 7 and discharged subsequently.

Figure 3:
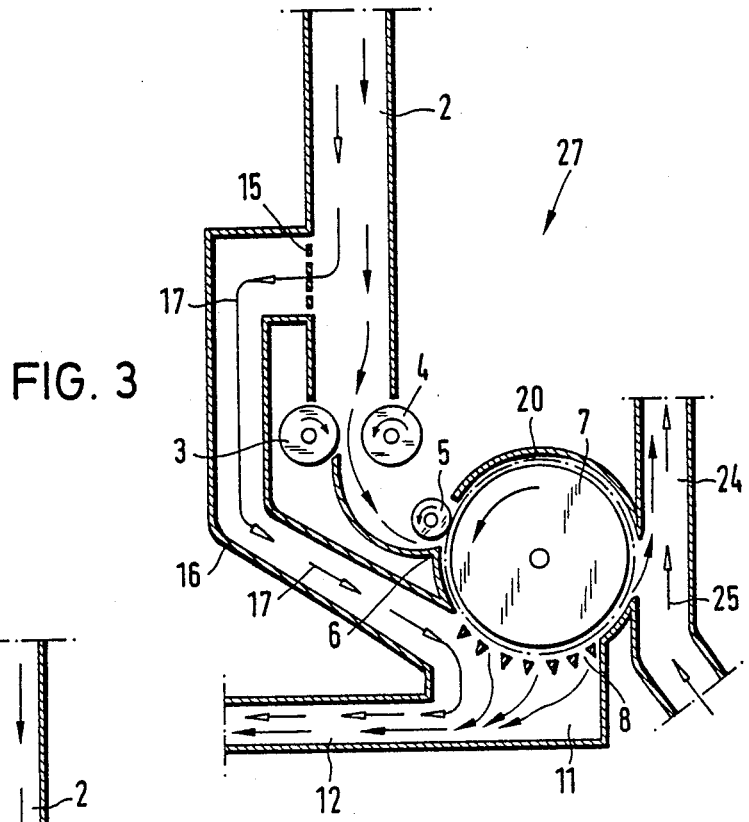
FIGS. 3 and 4 show elevational or schematic views of additional embodiments of the invention.

In the embodiment 27 of FIG. 3, which rather corresponds to that of FIG. 1, the wire 20 is provided with a toothing which makes closing of the discharge chamber 11 unnecessary. The opening roller 7 may be exposed directly to the conveying air current 17. Wire 20 ensures that the material fibers are not entrained by the conveying air current 17 as they pass the cleaning roller 8, which will be separated from the feed box by screen 15. It is possible to operate continuously.

Figure 4:
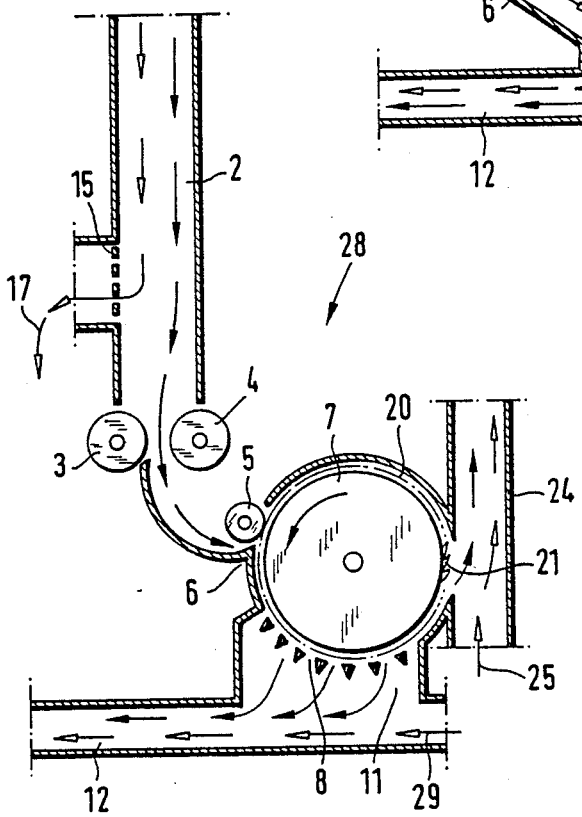

The advantages and effects of the embodiment of FIG. 3 are also incorporated in the embodiment of FIG. 4 of cleaning means 28. Opening or cleaning roller 7 is subjected to the effect of an additional separate air current 29 for discharging contaminants out of space 11. Teeth 21 of the wire 20 are provided at an acute angle relative to a tangent with the periphery of opening roller 7. A good cleaning effect is provided in spite of the continuously acting suction, due to the conveying air currents 17, 29. The material fibers are not drawn off the wire 20 and into the cleaning current.

While a preferred embodiment of the invention has been described using specific terms, such description is for illustrative purposes only, and it is to be understood that changes and variations may be made without departing from the spirit or scope of the following claims.

What is claimed is:

1. Apparatus for cleaning textile fibers such as cotton and the like in which the fibers are conveyed by a transport air current through a feed box to an opening roller, a cleaning grate is disposed in working relation to said opening roller, said transport air is separated at said feed box, and waste accumulating as contaminants beneath said cleaning grate is discharged, characterized in that means are provided for using said separated transport air for discharging said contaminants accumulating in a space beneath said cleaning grate.

2. Apparatus of claim 1 wherein said opening roller which cooperates with said cleaning grate includes a toothed wire having teeth with a top rake within a range of 30 degrees to 40 degrees.

3. Apparatus of claim 1 wherein said opening roller which cooperates with said cleaning grate includes a toothed wire having teeth with a top rake within a range of preferably 34 degrees to 37 degrees.

4. Apparatus of claim 1 including a wall which may be opened and closed for separating said space for said contaminants from said transport air.

5. Apparatus of claim 2 wherein said space beneath said cleaning grate is in continuous open fluid communication with said transport air.

6. Apparatus of claim 1 including means for providing an additional, separate air current beneath said grate for discharging said contaminants.

7. In an apparatus for cleaning textile fibers, the combination comprising:

a feed box to which said textile fibers are conveyed by transport air;

a fiber opening roller disposed near one end of said feed box;

a cleaning grate disposed in working relation to said opening roller through which contaminants are discharged from said fibers upon opening;

an air exit disposed in said feed box upstream of said opening roller through which said transport air is separated at said feed box;

a collection space disposed beneath said cleaning grate for accumulating said contaminants; and means for conveying said contaminants accumulating in said collection space away from said space using said separated transport air.

8. Apparatus of claim 7 wherein said means for conveying said contaminants away with said transport air includes duct means interconnecting said air exit in said feed box with said collection space.

9. Apparatus of claim 8 including a movable flap separating said collection space from said duct means.

10. Apparatus of claim 8 wherein said duct means openly communicates said air exit with said collection space.

11. Apparatus of claim 10 wherein said opening roller includes teeth disposed at an acute angle in a range of about 30 degrees to 40 degrees.

* * * * *